US008891776B2

(12) United States Patent
Ramamoorthy

(10) Patent No.: US 8,891,776 B2
(45) Date of Patent: Nov. 18, 2014

(54) DECODING OF MULTICHANNEL AUDIO ENCODED BIT STREAMS USING ADAPTIVE HYBRID TRANSFORMATION

(75) Inventor: Kamalanathan Ramamoorthy, Oakland, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 392 days.

(21) Appl. No.: 13/514,286

(22) PCT Filed: Oct. 28, 2010

(86) PCT No.: PCT/US2010/054480

§ 371 (c)(1),
(2), (4) Date: Jun. 6, 2012

(87) PCT Pub. No.: WO2011/071610

PCT Pub. Date: Jun. 16, 2011

(65) Prior Publication Data

US 2012/0243692 A1 Sep. 27, 2012

Related U.S. Application Data

(60) Provisional application No. 61/267,422, filed on Dec. 7, 2009.

(51) Int. Cl.

| | |
|---|---|
| ***H04R 5/00*** | (2006.01) |
| ***G10L 19/008*** | (2013.01) |
| ***G10L 19/02*** | (2013.01) |

(52) U.S. Cl.

CPC ..... *G10L 19/008* (2013.01); *G10L 19/0212* (2013.01)

USPC ..... 381/22

(58) Field of Classification Search

CPC ..... H04S 3/02; H04S 5/00

USPC ..... 381/22

See application file for complete search history.

(56) References Cited

U.S. PATENT DOCUMENTS

| | | | |
|---|---|---|---|
| 5,583,962 | A | 12/1996 | Todd |
| 6,246,345 | B1 | 6/2001 | Davidson |
| 7,516,064 | B2 | 4/2009 | Vinton |
| 2003/0236583 | A1 | 12/2003 | Baumgarte |
| 2004/0049379 | A1 | 3/2004 | Thumpudi |

FOREIGN PATENT DOCUMENTS

| | | |
|---|---|---|
| CN | 1512028 | 7/2004 |
| CN | 101067931 | 11/2007 |

OTHER PUBLICATIONS

Advanced Television Systems Committee, "A/52B, ATSC Standard, Digital Audio Compression Standard (AC-3, E-AC-3), revision B", Jun. 14, 2005, pp. 51-55 and pp. 172-214.

Sakamoto, H., et al., "A Dolby AC-3/MPEG1 Audio Decoder Core Suitable for Audio/Visual System Integration" Custom Integrated Circuits Conference, 1997, Proceedings of the IEEE 1997 Santa Clara, CA May 1997.

Andersen, R.L., et al., "Introduction to Dolby Digital Plus, an Enhancement to the Dolby Digital Coding System" AES Convention 117, Oct. 2004, AES.

*Primary Examiner* — Sonia Gay

(57) ABSTRACT

The processing efficiency of a process used to decode frames of an enhanced AC-3 bit stream is improved by processing each audio block in a frame only once. Audio blocks of encoded data are decoded in block order rather than in channel order. Exemplary decoding processes for enhanced bit stream coding features such as adaptive hybrid transform processing and spectral extension are disclosed.

21 Claims, 5 Drawing Sheets

DECODING OF MULTICHANNEL AUDIO ENCODED BIT STREAMS USING ADAPTIVE HYBRID TRANSFORMATION

CROSS-REFERENCE TO RELATED APPLICATIONS

This application claims priority to U.S. Provisional Patent Application No. 61/267,422 filed 7 Dec. 2009, which is hereby incorporated by reference in its entirety.

TECHNICAL FIELD

The present invention pertains generally to audio coding systems and pertains more specifically to methods and devices that decode encoded digital audio signals.

BACKGROUND ART

The United States Advanced Television Systems Committee (ATSC), Inc., which was formed by member organizations of the Joint Committee on InterSociety Coordination (JCIC), developed a coordinated set of national standards for the development of U.S. domestic television services. These standards including relevant audio encoding/decoding standards are set forth in several documents including Document A/52B entitled "Digital Audio Compression Standard (AC-3, E-AC-3)," Revision B, published Jun. 14, 2005, which is incorporated herein by reference in its entirety. The audio coding algorithm specified in Document A/52B is referred to as "AC-3." An enhanced version of this algorithm, which is described in Annex E of the document, is referred to as "E-AC-3." These two algorithms are referred to herein as "AC-3" and the pertinent standards are referred to herein as the "ATSC Standards."

The A/52B document does not specify very many aspects of algorithm design but instead describes a "bit stream syntax" defining structural and syntactical features of the encoded information that a compliant decoder must be capable of decoding. Many applications that comply with the ATSC Standards will transmit encoded digital audio information as binary data in a serial manner. As a result, the encoded data is often referred to as a bit stream but other arrangements of the data are permissible. For ease of discussion, the term "bit stream" is used herein to refer to an encoded digital audio signal regardless of the format or the recording or transmission technique that is used.

A bit stream that complies with the ATSC Standards is arranged in a series of "synchronization frames." Each frame is a unit of the bit stream that is capable of being fully decoded into one or more channels of pulse code modulated (PCM) digital audio data. Each frame includes "audio blocks" and frame metadata that is associated with the audio blocks. Each of the audio blocks contain encoded audio data representing digital audio samples for one or more audio channels and block metadata associated with the encoded audio data.

Although details of algorithmic design are not specified in the ATSC Standards, certain algorithmic features have been widely adopted by the manufacturers of professional and consumer decoding equipment. One universal feature of implementation for decoders that can decode enhanced AC-3 bit streams generated by E-AC-3 encoders is an algorithm that decodes all encoded data in a frame for a respective channel before decoding data for another channel. This approach has been used to improve the performance of implementations on single-chip processors having little on-chip memory because some decoding processes require data for a given channel from each of the audio blocks in a frame. By processing the encoded data in channel order, decoding operations can be performed using on-chip memory for a particular channel. The decoded channel data can subsequently be transferred to off-chip memory to free up on-chip resources for the next channel.

A bit stream that complies with the ATSC Standards can be very complex because a large number of variations are possible. A few examples mentioned here only briefly include channel coupling, channel rematrixing, dialog normalization, dynamic range compression, channel downmixing and block-length switching for standard AC-3 bit streams, and multiple independent streams, dependent substreams, spectral extension and adaptive hybrid transformation for enhanced AC-3 bit streams. Details for these features can be obtained from the A/52B document.

By processing each channel independently, the algorithms required for these variations can be simplified. Subsequent complex processes like synthesis filtering can be performed without concern for these variations. Simpler algorithms would seem to provide a benefit in reducing the computational resources needed to process a frame of audio data.

Unfortunately, this approach requires the decoding algorithm to read and examine data in all of the audio blocks twice. Each iteration of reading and examining audio block data in a frame is referred to herein as a "pass" over the audio blocks. The first pass performs extensive calculations to determine the location of the encoded audio data in each block. The second pass performs many of these same calculations as it performs the decoding processes. Both passes require considerable computational resources to calculate the data locations. If the initial pass can be eliminated, it may be possible to reduce the total processing resources needed to decode a frame of audio data.

DISCLOSURE OF INVENTION

It is an object of the present invention to reduce the computational resources required to decode a frame of audio data in encoded bit streams arranged in hierarchical units like the frames and audio blocks mentioned above. The preceding text and the following disclosure refer to encoded bit streams that comply with the ATSC Standards but the present invention is not limited to use with only these bit streams. Principles of the present invention may be applied to essentially any encoded bit stream that has structural features similar to the frames, blocks and channels used in AC-3 coding algorithms.

According to one aspect of the present invention, a method decodes a frame of an encoded digital audio signal by receiving the frame and examining the encoded digital audio signal in a single pass to decode the encoded audio data for each audio block in order by block. Each frame comprises frame metadata and a plurality of audio blocks. Each audio block comprises block metadata and encoded audio data for one or more audio channels. The block metadata comprises control information describing coding tools used by an encoding process that produced the encoded audio data. One of the coding tools is hybrid transform processing that applies an analysis filter bank implemented by a primary transform to one or more audio channels to generate spectral coefficients representing spectral content of the one or more audio channels, and applies a secondary transform to the spectral coefficients for at least some of the one or more audio channels to generate hybrid transform coefficients. The decoding of each audio block determines whether the encoding process used adaptive hybrid transform processing to encode any of the encoded audio data. If the encoding process used adaptive hybrid transform processing, the method obtains all hybrid transform coefficients for the frame from the encoded audio data in the first audio block in the frame and applies an inverse secondary transform to the hybrid transform coefficients to obtain inverse secondary transform coefficients and obtains spectral coefficients from the inverse secondary transform coefficients. If the encoding process did not use adaptive hybrid transform processing, spectral coefficients are obtained from the encoded audio data in the respective audio block. An inverse primary transform is applied to the spectral coefficients to generate an output signal representing the one or more channels in the respective audio block.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Overview of Coding System

Figure 1:
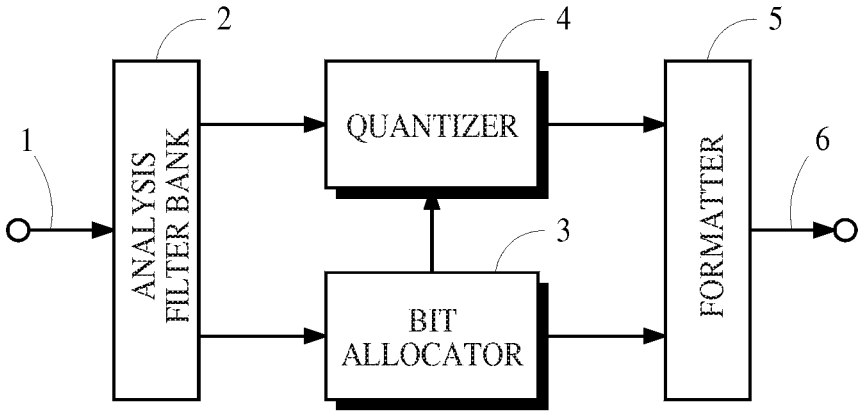
FIG. 1 is a schematic block diagram of exemplary implementations of an encoder.
Figure 2:
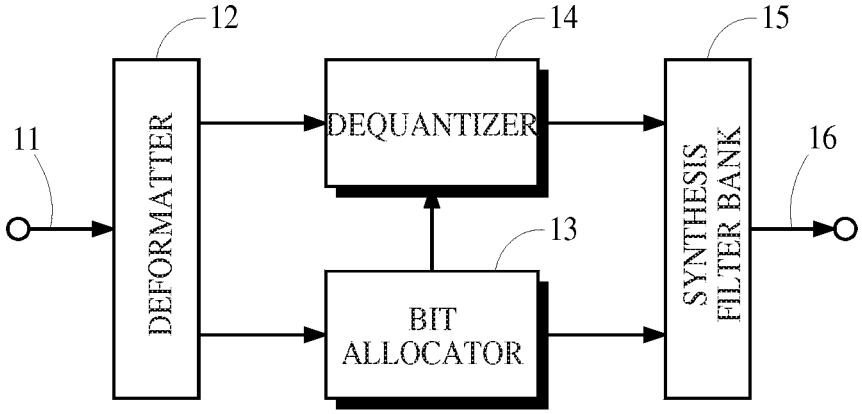
FIG. 2 is a schematic block diagram of exemplary implementations of a decoder.

FIGS. 1 and 2 are schematic block diagrams of exemplary implementations of an encoder and a decoder for an audio coding system in which the decoder may incorporate various aspects of the present invention. These implementations conform to what is disclosed in the A/52B document cited above.

The purpose of the coding system is to generate an encoded representation of input audio signals that can be recorded or transmitted and subsequently decoded to produce output audio signals that sound essentially identical to the input audio signals while using a minimum amount of digital information to represent the encoded signal. Coding systems that comply with the basic ATSC Standards are capable of encoding and decoding information that can represent from one to so-called 5.1 channels of audio signals, where 5.1 is understood to mean five channels that can carry full-bandwidth signals and one channel of limited-bandwidth that is intended to carry signals for low-frequency effects (LFE).

The following sections describe implementations of the encoder and decoder, and some details of encoded bit stream structure and related encoding and decoding processes. These descriptions are provided so that various aspects of the present invention can be described more succinctly and understood more clearly.

1. Encoder

Referring to the exemplary implementation in FIG. 1, the encoder receives a series of pulse code modulated (PCM) samples representing one or more input channels of audio signals from the input signal path 1, and applies an analysis filter bank 2 to the series of samples to generate digital values representing the spectral composition of the input audio signals. For embodiments that comply with the ATSC Standards, the analysis filter bank is implemented by a Modified Discrete Cosine Transform (MDCT) described in the A/52B document. The MDCT is applied to overlapping segments or blocks of samples for each input channel of audio signal to generate blocks of transform coefficients that represent the spectral composition of that input channel signal. The MDCT is part of an analysis/synthesis system that uses specially designed window functions and overlap/add processes to cancel time-domain aliasing. The transform coefficients in each block are expressed in a block-floating point (BFP) form comprising floating-point exponents and mantissas. This description refers to audio data expressed as floating-point exponents and mantissas because this form of representation is used in bit streams that comply with the ATSC Standards; however, this particular representation is merely one example of numerical representations that use scale factors and associated scaled values.

The BFP exponents for each block collectively provide an approximate spectral envelope for the input audio signal. These exponents are encoded by delta modulation and other coding techniques to reduce information requirements, passed to the formatter 5, and input into a psychoacoustic model to estimate the psychoacoustic masking threshold of the signal being encoded. The results from the model are used by the bit allocator 3 to allocate digital information in the form of bits for quantization of the mantissas in such a manner that the level of noise produced by quantization is kept below the psychoacoustic masking threshold of the signal being encoded. The quantizer 4 quantizes the mantissas according to the bit allocations received from the bit allocator 3 and passed to the formatter 5.

The formatter 5 multiplexes or assembles the encoded exponents, the quantized mantissas and other control information, sometimes referred to as block metadata, into audio blocks. The data for six successive audio blocks are assembled into units of digital information called frames. The frames themselves also contain control information or frame metadata. The encoded information for successive frames are output as a bit stream along the path 6 for recording on an information storage medium or for transmission along a communication channel. For encoders that comply with the ATSC Standards, the format of each frame in the bit stream complies with the syntax specified in the A/52B document.

The coding algorithm used by typical encoders that comply with the ATSC Standards are more complicated than what is illustrated in FIG. 1 and described above. For example, error detection codes are inserted into the frames to allow a receiving decoder to validate the bit stream. A coding technique known as block-length switching, sometimes referred to more simply as block switching, may be used to adapt the temporal and spectral resolution of the analysis filter bank to optimize its performance with changing signal characteristics. The floating-point exponents may be encoded with variable time and frequency resolution. Two or more channels may be combined into a composite representation using a coding technique known as channel coupling. Another coding technique known as channel rematrixing may be used adaptively for two-channel audio signals. Additional coding techniques may be used that are not mentioned here. A few of these other coding techniques are discussed below. Many other details of implementation are omitted because they are not needed to understand the present invention. These details may be obtained from the A/52B document as desired.

2. Decoder

The decoder performs a decoding algorithm that is essentially the inverse of the coding algorithm that is performed in the encoder. Referring to the exemplary implementation in FIG. 2, the decoder receives an encoded bit stream representing a series of frames from the input signal path 11. The encoded bit stream may be retrieved from an information storage medium or received from a communication channel. The deformatter 12 demultiplexes or disassembles the encoded information for each frame into frame metadata and six audio blocks. The audio blocks are disassembled into their respective block metadata, encoded exponents and quantized mantissas. The encoded exponents are used by a psychoacoustic model in the bit allocator 13 to allocate digital information in the form of bits for dequantization of the quantized mantissas in the same manner as bits were allocated in the encoder. The dequantizer 14 dequantizes the quantized mantissas according to the bit allocations received from the bit allocator 13 and passes the dequantized mantissas to the synthesis filter bank 15. The encoded exponents are decoded and passed to the synthesis filter bank 15.

The decoded exponents and dequantized mantissas constitute a BFP representation of the spectral content of the input audio signal as encoded by the encoder. The synthesis filter bank 15 is applied to the representation of spectral content to reconstruct an inexact replica of the original input audio signals, which is passed along the output signal path 16. For embodiments that comply with the ATSC Standards, the synthesis filter bank is implemented by an Inverse Modified Discrete Cosine Transform (IMDCT) described in the A/52B document. The IMDCT is part of an analysis/synthesis system mentioned above briefly that is applied to blocks of transform coefficients to generate blocks of audio samples that are overlapped and added to cancel time-domain aliasing.

The decoding algorithm used by typical decoders that comply with the ATSC Standards are more complicated that what is illustrated in FIG. 2 and described above. A few decoding techniques that are the inverse of the coding techniques described above include error detection for error correction or concealment, block-length switching to adapt the temporal and spectral resolution of the synthesis filter bank, channel decoupling to recover channel information from coupled composite representations, and matrix operations for recovery of rematrixed two-channel representations. Information about other techniques and additional detail may be obtained from the A/52B document as desired.

B. Encoded Bit Stream Structure

1. Frame

Figure 3A:
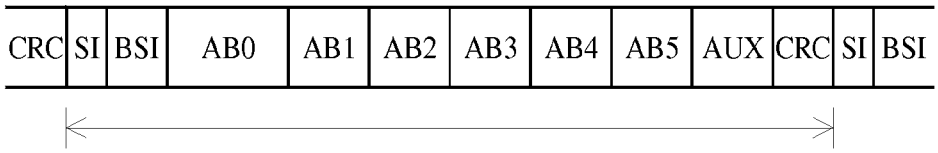
FIGS. 3A and 3B are schematic illustrations of frames in bit streams complying with standard and enhanced syntactical structures.
Figure 3B:
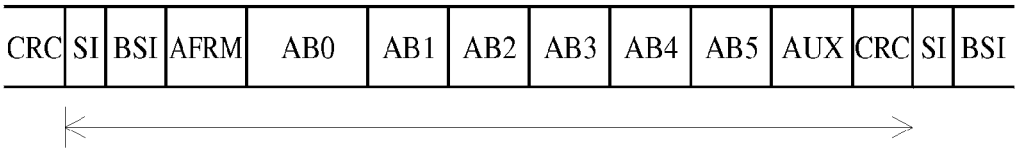

An encoded bit stream that complies with the ATSC Standards comprises a series of encoded information units called "synchronization frames" that are sometimes referred to more simply as frames. As mentioned above, each frame contains frame metadata and six audio blocks. Each audio block contains block metadata and encoded BFP exponents and mantissas for a concurrent interval of one or more channels of audio signals. The structure for the standard bit stream is illustrated schematically in FIG. 3A. The structure for an enhanced AC-3 bit stream as described in Annex E of the A/52B document is illustrated in FIG. 3B. The portion of each bit stream within the marked interval from SI to CRC is one frame.

A special bit pattern or synchronization word is included in synchronization information (SI) that is provided at the start of each frame so that a decoder may identify the start of a frame and maintain synchronization of its decoding processes with the encoded bit stream. A bit stream information (BSI) section immediately following the SI carries parameters that are needed by the decoding algorithm to decode the frame. For example, the BSI specifies the number, type and order of channels that are represented by encoded information in the frame, and the dynamic range compression and dialogue normalization information to be used by the decoder. Each frame contains six audio blocks (AB0 to AB5), which may be followed by auxiliary (AUX) data if desired. Error detection information in the form of a cyclical redundancy check (CRC) word is provided at the end of each frame.

A frame in the enhanced AC-3 bit stream also contains audio frame (AFRM) data that contains flags and parameters that pertain to additional coding techniques that are not available for use in coding a standard bit stream. Some of the additional techniques include the use of spectral extension (SPX), also known as spectral replication, and adaptive hybrid transform (AHT). Various coding techniques are discussed below.

2. Audio Blocks

Figure 4A:
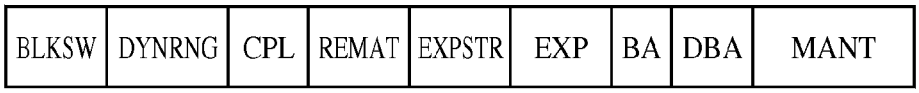
FIGS. 4A and 4B are schematic illustrations of audio blocks that comply with standard and enhanced syntactical structures.
Figure 4B:
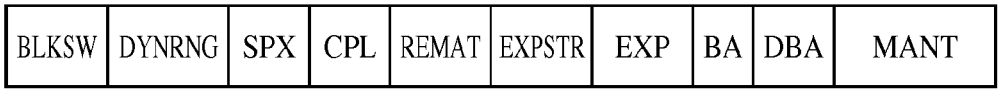

Each audio block contains encoded representations of BFP exponents and quantized mantissas for 256 transform coefficients, and block metadata needed to decode the encoded exponents and quantized mantissas. This structure is illustrated schematically in FIG. 4A. The structure for the audio block in an enhanced AC-3 bit stream as described in Annex E of the A/52B document is illustrated in FIG. 4B. An audio block structure in an alternate version of the bit stream as described in Annex D of the A/52B document is not discussed here because its unique features are not pertinent to the present invention.

Some examples of block metadata include flags and parameters for block switching (BLKSW), dynamic range compression (DYNRNG), channel coupling (CPL), channel rematrixing (REMAT), exponent coding technique or strategy (EXPSTR) used to encode the BFP exponents, the encoded BFP exponents (EXP), bit allocation (BA) information for the mantissas, adjustments to bit allocation known as delta bit allocation (DBA) information, and the quantized mantissas (MANT). Each audio block in an enhanced AC-3 bit stream may contain information for additional coding techniques including spectral extension (SPX).

3. Bit Stream Constraints

The ATSC Standards impose some constraints on the contents of the bit stream that are pertinent to the present invention. Two constraints are mentioned here: (1) the first audio block in the frame, which is referred to as AB0, must contain all of the information needed by the decoding algorithm to begin decoding all of the audio blocks in the frame, and (2) whenever the bit stream begins to carry encoded information generated by channel coupling, the audio block in which channel coupling is first used must contain all the parameters needed for decoupling. These features are discussed below. Information about other processes not discussed here may be obtained from the A/52B document.

C. Standard Coding Processes and Techniques

The ATSC Standards describe a number of bit stream syntactical features in terms of encoding processes or "coding tools" that may be used to generate an encoded bit stream. An encoder need not employ all of the coding tools but a decoder that complies with the standard must be able to respond to the coding tools that are deemed essential for compliance. This response is implemented by performing an appropriate decoding tool that is essentially the inverse of the corresponding coding tool.

Some of the decoding tools are particularly relevant to the present invention because their use or lack of use affects how aspects of the present invention should be implemented. A few decoding processes and a few decoding tools are discussed briefly in the following paragraphs. The following descriptions are not intended to be a complete description. Various details and optional features are omitted. The descriptions are intended only to provide a high-level introduction to those who are not familiar with the techniques and to refresh memories of those who may have forgotten which techniques these terms describe.

If desired, additional details may be obtained from the A/52B document, and from U.S. Pat. No. 5,583,962 entitled "Encoder/Decoder for Multi-Dimensional Sound Fields" by Davis et al., which issued Dec. 10, 1996 and is incorporated herein by reference in its entirety.

1. Bit Stream Unpacking

All decoders must unpack or demultiplex the encoded bit stream to obtain parameters and encoded data. This process is represented by the deformatter 12 discussed above. This process is essentially one that reads data in the incoming bit stream and copies portions of the bit stream to registers, copies portions to memory locations, or stores pointers or other references to data in the bit stream that are stored in a buffer. Memory is required to store the data and pointers and a tradeoff can be made between storing this information for later use or re-reading the bit stream to obtain the information whenever it is needed.

2. Exponent Decoding

The values of all BFP exponents are needed to unpack the data in the audio blocks for each frame because these values indirectly indicate the numbers of bits that are allocated to the quantized mantissas. The exponent values in the bit stream are encoded, however, by differential coding techniques that may be applied across both time and frequency. As a result, the data representing the encoded exponents must be unpacked from the bit stream and decoded before they can be used for other decoding processes.

3. Bit Allocation Processing

Each of the quantized BFP mantissas in the bit stream are represented by a varying number of bits that are a function of the BFP exponents and possibly other metadata contained in the bit stream. The BFP exponents are input to a specified model, which calculates a bit allocation for each mantissa. If an audio block also contains delta bit allocation (DBA) information, this additional information is used to adjust the bit allocation calculated by the model.

4. Mantissa Processing

The quantized BFP mantissas constitute most of the data in an encoded bit stream. The bit allocation is used both to determine the location of each mantissa in the bit stream for unpacking as well as to select the appropriate dequantization function to obtain the dequantized mantissas. Some data in the bit stream can represent multiple mantissas by a single value. In this situation, an appropriate number of mantissas are derived from the single value. Mantissas that have an allocation equal to zero may be reproduced either with a value equal to zero or as a pseudo-random number.

5. Channel Decoupling

The channel coupling coding technique allows an encoder to represent multiple audio channels with less data. The technique combines spectral components from two or more selected channels, referred to as the coupled channels, to form a single channel of composite spectral components, referred to as the coupling channel. The spectral components of the coupling channel are represented in BFP format. A set of scale factors describing the energy difference between the coupling channel and each coupled channel, known as coupling coordinates, is derived for each of the coupled channels and included in the encoded bit stream. Coupling is used for only a specified portion of the bandwidth of each channel.

When channel coupling is used, as indicated by parameters in the bit stream, a decoder uses a decoding technique known as channel decoupling to derive an inexact replica of the BFP exponents and mantissas for each coupled channel from the spectral components of the coupling channel and the coupling coordinates. This is done by multiplying each coupled channel spectral component by the appropriate coupling coordinate. Additional details may be obtained from the A/52B document.

6. Channel Rematrixing

The channel rematrixing coding technique allows an encoder to represent two-channel signals with less data by using a matrix to convert two independent audio channels into sum and difference channels. The BFP exponent and mantissas normally packed into a bit stream for left and right audio channels instead represent the sum and difference channels. This technique may be used advantageously when the two channels have a high degree of similarity.

When rematrixing is used, as indicated by a flag in the bit stream, a decoder obtains values representing the two audio channels by applying an appropriate matrix to the sum and difference values. Additional details may be obtained from the A/52B document.

D. Enhanced Coding Processes and Techniques

Annex E of the A/52B describes features of the enhanced AC-3 bit stream syntax that permits the use of additional coding tools. A few of these tools and related processes are described briefly below.

1. Adaptive Hybrid Transform Processing

The adaptive hybrid transform (AHT) coding technique provides another tool in addition to block switching for adapting the temporal and spectral resolution of the analysis and synthesis filter banks in response to changing signal characteristics by applying two transforms in cascade. Additional information for AHT processing may be obtained from the A/52B document and U.S. Pat. No. 7,516,064 entitled "Adaptive Hybrid Transform for Signal Analysis and Synthesis" by Vinton et al., which issued Apr. 7, 2009 and is incorporated herein by reference in its entirety.

Encoders employ a primary transform implemented by the MDCT analysis transform mentioned above in front of and in cascade with a secondary transform implemented by a Type-II Discrete Cosine Transform (DCT-II). The MDCT is applied to overlapping blocks of audio signal samples to generate spectral coefficients representing spectral content of the audio signal. The DCT-II may be switched in and out of the signal processing path as desired and, when switched in, is applied to non-overlapping blocks of the MDCT spectral coefficients representing the same frequency to generate hybrid transform coefficients. In typical use, the DCT-II is switched on when the input audio signal is deemed to be sufficiently stationary because its use significantly increases the effective spectral resolution of the analysis filter bank by decreasing its effective temporal resolution from 256 samples to 1536 samples.

Decoders employ an inverse primary transform implemented by the IMDCT synthesis filter bank mentioned above that follows and is in cascade with an inverse secondary transform implemented by a Type-II Inverse Discrete Cosine Transform (IDCT-II). The IDCT-II is switched in and out of the signal processing path in response to metadata provided by the encoder. When switched in, the IDCT-II is applied to non-overlapping blocks of hybrid transform coefficients to obtain inverse secondary transform coefficients. The inverse secondary transform coefficients may be spectral coefficients for direct input into the IMDCT if no other coding tool like channel coupling or SPX was used. Alternatively, the MDCT spectral coefficients may be derived from the inverse secondary transform coefficients if coding tools like channel coupling or SPX were used. After the MDCT spectral coefficients are obtained, the IMDCT is applied to blocks of the MDCT spectral coefficients in a conventional manner.

The AHT may be used with any audio channel including the coupling channel and the LFE channel. A channel that is encoded using the AHT uses an alternative bit allocation process and two different types of quantization. One type is vector quantization (VQ) and the second type is gain-adaptive quantization (GAQ). The GAQ technique is discussed in U.S. Pat. No. 6,246,345 entitled "Using Gain-Adaptive Quantization and Non-Uniform Symbol Lengths for Improved Audio Coding" by Davidson et al., which issued Jun. 12, 2001 and is incorporated herein by reference in its entirety.

Use of the AHT requires a decoder to derive several parameters from information contained in the encoded bit stream. The A/52B document describes how these parameters can be calculated. One set of parameters specify the number of times BFP exponents are carried in a frame and are derived by examining metadata contained in all audio blocks in a frame. Two other sets of parameters identify which BFP mantissas are quantized using GAQ and provide gain-control words for the quantizers and are derived by examining metadata for a channel in an audio block.

All of the hybrid transform coefficients for AHT are carried in the first audio block, AB0, of a frame. If the AHT is applied to a coupling channel, the coupling coordinates for the AHT coefficients are distributed across all of the audio blocks in the same manner as for coupled channels without AHT. A process to handle this situation is described below.

2. Spectral Extension Processing

The spectral extension (SPX) coding technique allows an encoder to reduce the amount of information needed to encode a full-bandwidth channel by excluding high-frequency spectral components from the encoded bit stream and having the decoder synthesize the missing spectral components from lower-frequency spectral components that are contained in the encoded bit stream.

When SPX is used, the decoder synthesizes missing spectral components by copying lower-frequency MDCT coefficients into higher-frequency MDCT coefficient locations, adding pseudo-random values or noise to the copied transform coefficients, and scaling the amplitude according to a SPX spectral envelope included in the encoded bit stream. The encoder calculates the SPX spectral envelope and inserts it into the encoded bit stream whenever the SPX coding tool is used.

The SPX technique is used typically to synthesize the highest bands of spectral components for a channel. It may be used together with channel coupling for a middle range of frequencies. Additional details of processing may be obtained from the A/52B document.

3. Channel and Program Extensions

The enhanced AC-3 bit stream syntax allows an encoder to generate an encoded bit stream that represents a single program with more than 5.1 channels (channel extension), two or more programs with up to 5.1 channels (program extension), or a combination of programs with up to 5.1 channels and more than 5.1 channels. Program extension is implemented by a multiplex of frames for multiple independent data streams in an encoded bit stream. Channel extension is implemented by a multiplex of frames for one or more dependent data substreams that are associated with an independent data stream. In preferred implementations for program extension, a decoder is informed which program or programs to decode and the decoding process skips over or essentially ignores the streams and substreams representing programs that are not to be decoded.

Figure 5A:
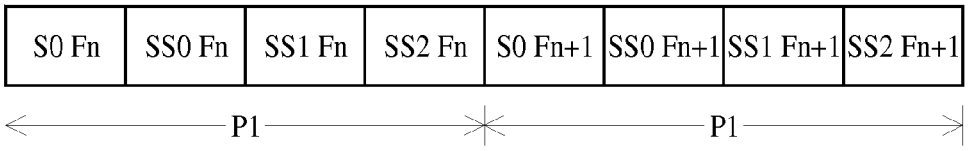
FIGS. 5A to 5C are schematic illustrations of exemplary bit streams carrying data with program and channel extensions.
Figure 5B:
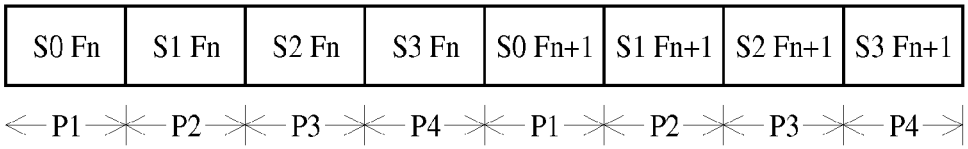
Figure 5C:
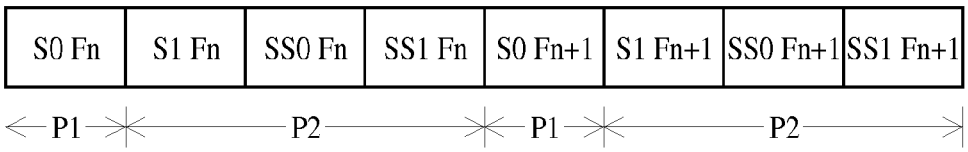

FIGS. 5A to 5C illustrate three examples of bit streams carrying data with program and channel extensions. FIG. 5A illustrates an exemplary bit stream with channel extension. A single program P1 is represented by an independent stream S0 and three associated dependent substreams SS0, SS1 and SS2. A frame Fn for the independent stream S0 is followed immediately by frames Fn for each of the associated dependent substreams SS0 to SS3. These frames are followed by the next frame Fn+1 for the independent stream S0, which in turn is followed immediately by frames Fn+1 for each of the associated dependent substreams SS0 to SS2. The enhanced AC-3 bit stream syntax permits as many as eight dependent substreams for each independent stream.

FIG. 5B illustrates an exemplary bit stream with program extension. Each of four programs P1, P2, P3 and P4 are represented by independent streams S0, S1, S2 and S3, respectively. A frame Fn for independent stream S0 is followed immediately by frames Fn for each of independent streams S1, S2 and S3. These frames are followed by the next frame Fn+1 for each of the independent streams. The enhanced AC-3 bit stream syntax must have at least one independent stream and permits as many as eight independent streams.

FIG. 5C illustrates an exemplary bit stream with program extension and channel extension. Program P1 is represented by data in independent stream S0, and program P2 is represented by data in independent stream S1 and associated dependent substreams SS0 and SS1. A frame Fn for independent stream S0 is followed immediately by frame Fn for independent stream S1, which in turn is followed immediately by frames Fn for the associated dependent substreams SS0 and SS1. These frames are followed by the next frame Fn+1 for each of the independent streams and dependent substreams.

An independent stream without channel extension contains data that may represent up to 5.1 independent audio channels. An independent stream with channel extension or, in other words, an independent stream that has one or more associated dependent substreams, contains data that represents a 5.1 channel downmix of all channels for the program. The term "downmix" refers to a combination of channels into a fewer number of channels. This is done for compatibility with decoders that do not decode the dependent substreams. The dependent substreams contain data representing channels that either replace or supplement the channels carried in the associated independent stream. Channel extension permits as many as fourteen channels for a program.

Additional details of bit stream syntax and associate processing may be obtained from the A/52B document.

E. Block-Priority Processing

Complex logic is required to process and properly decode the many variations in bit stream structure that occur when various combinations of coding tools are used to generate the encoded bit stream. As mentioned above, details of algorithmic design are not specified in the ATSC Standards but a universal feature of conventional implementation of E-AC-3 decoders is an algorithm that decodes all data in a frame for a respective channel before decoding data for another channel. This traditional approach reduces the amount of on-chip memory needed to decode the bit stream but it also requires multiple passes over the data in each frame to read and examine data in all of the audio blocks of the frame.

Figure 6:
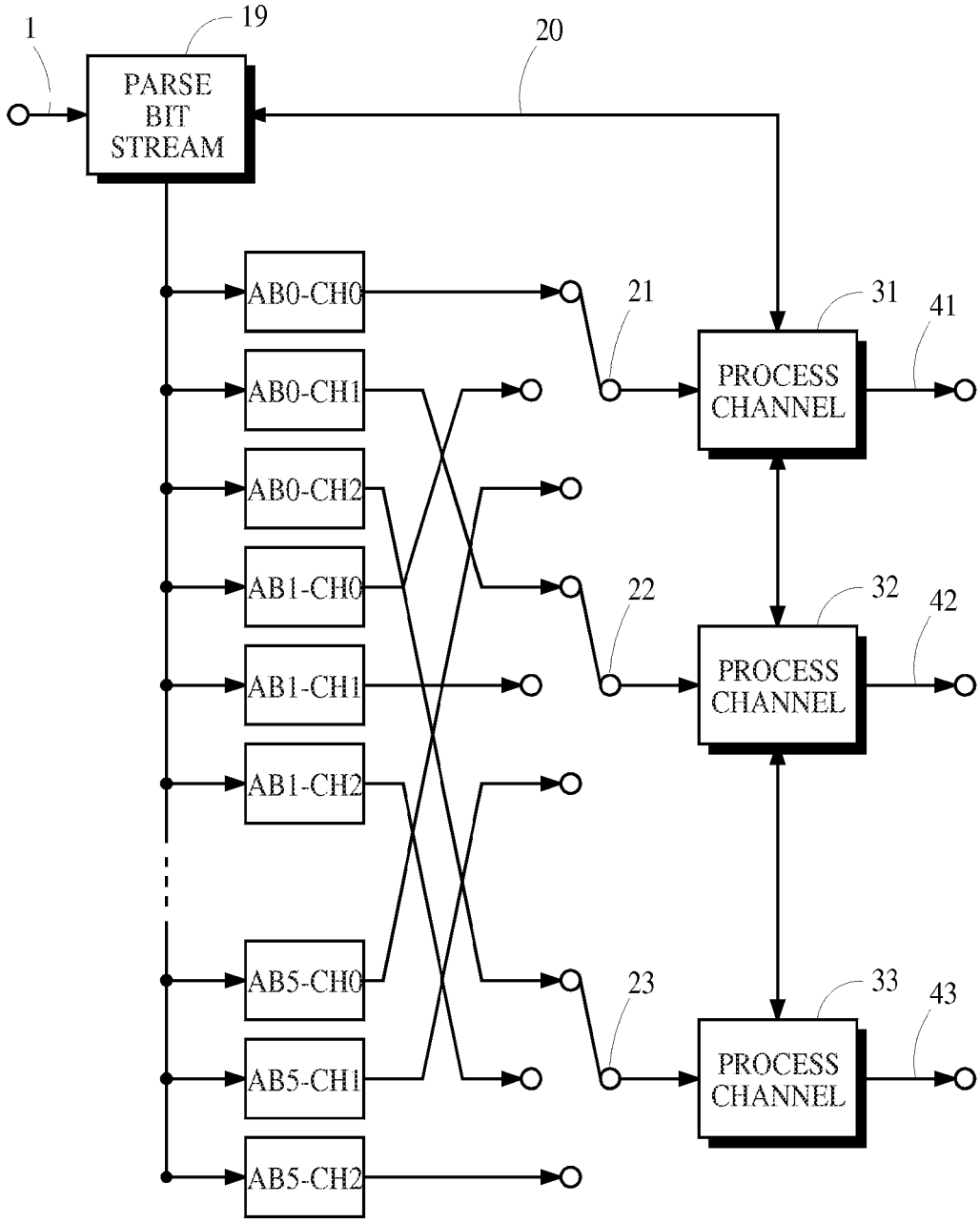
FIG. 6 is a schematic block diagram of an exemplary process implemented by a decoder that process encoded audio data in channel order.

The traditional approach is illustrated schematically in FIG. 6. The component 19 parses frames from an encoded bit stream received from the path 1 and extracts data from the frames in response to control signals received from the path 20. The parsing is accomplished by multiple passes over the frame data. The extracted data from one frame is represented by the boxes below the component 19. For example, the box with the label AB0-CH0 represents extracted data for channel 0 in audio block AB0 and the box with the label AB5-CH2 represents extracted data for channel 2 in audio block AB5. Only three channels 0 to 2 and three audio blocks 0, 1 and 5 are illustrated to simplify the drawing. The component 19 also passes parameters obtained from frame metadata along the path 20 to the channel processing components 31, 32 and 33. The signal paths and rotary switches to the left of the data boxes represent the logic performed by traditional decoders to process encoded audio data in order by channel. The process channel component 31 receives encoded audio data and metadata through the rotary switch 21 for channel CH0, starting with audio block AB0 and concluding with audio block AB5, decodes the data and generates an output signal by applying a synthesis filter bank to the decoded data. The results of its processing is passed along the path 41. The process channel component 32 receives data for channel CH1 for audio blocks AB0 to AB5 through the rotary switch 22, processes the data and passes its output along the path 42. The process channel component 33 receives data for channel CH2 for audio blocks AB0 to AB5 through the rotary switch 23, processes the data and passes its output along the path 43.

Figure 7:
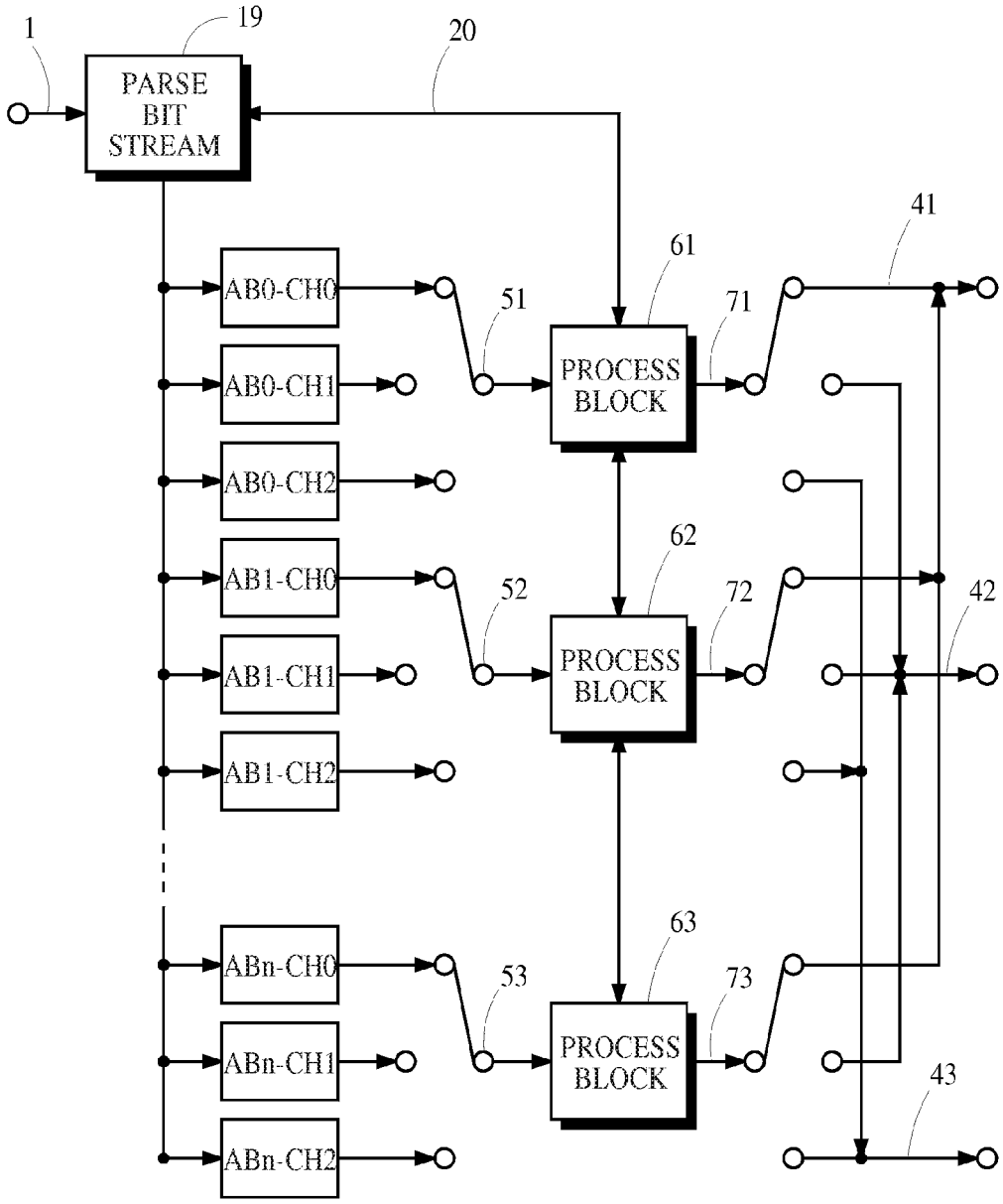
FIG. 7 is a schematic block diagram of an exemplary process implemented by a decoder that process encoded audio data in block order.

Applications of the present invention can improve processing efficiency by eliminating multiple passes over the frame data in many situations. Multiple passes are used in some situations when certain combinations of coding tools are used to generate the encoded bit stream; however, enhanced AC-3 bit streams generated by the combinations of coding tools discussed below may be decoded with a single pass. This new approach is illustrated schematically in FIG. 7. The component 19 parses frames from an encoded bit stream received from the path 1 and extracts data from the frames in response to control signals received from the path 20. In many situations, the parsing is accomplished by a single pass over the frame data. The extracted data from one frame is represented by the boxes below the component 19 in the same manner discussed above for FIG. 6. The component 19 passes parameters obtained from frame metadata along the path 20 to the block processing components 61, 62 and 63. The process block component 61 receives encoded audio data and metadata through the rotary switch 51 for all of the channels in audio block AB0, decodes the data and generates an output signal by applying a synthesis filter bank to the decoded data. The results of its processing for channels CH0, CH1 and CH2 are passed through the rotary switch 71 to the appropriate output path 41, 42 and 43, respectively. The process block component 62 receives data for all channels in audio block AB1 through the rotary switch 52, processes the data and passes its output through the rotary switch 72 to the appropriate output path for each channel. The process block component 63 receives data for all channels in audio block AB5 through the rotary switch 53, processes the data and passes its output through the rotary switch 73 to the appropriate output path for each channel.

Various aspects of the present invention are discussed below and illustrated with program fragments. These program fragments are not intended to be practical or optimal implementations but only illustrative examples. For example, the order of program statements may be altered by interchanging some of the statements.

1. General Process

A high-level illustration of the present invention is shown in the following program fragment:

```
(1.1)   determine start of a frame in bit stream S
(1.2)   for each frame N in bit stream S
(1.3)     unpack metadata in frame N
(1.4)     get parameters from unpacked frame metadata
(1.5)     determine start of first audio block K in frame N
(1.6)     for audio block K in frame N
(1.7)       unpack metadata in block K
(1.8)       get parameters from unpacked block metadata
(1.9)       determine start of first channel C in block K
(1.10)      for channel C in block K
(1.11)        unpack and decode exponents
(1.12)        unpack and dequantize mantissas
(1.13)        apply synthesis filter to decoded audio data for channel C
(1.14)        determine start of channel C+1 in block K
(1.15)      end for
(1.16)      determine start of block K+1 in frame N
(1.17)    end for
(1.18)    determine start of next frame N+1 in bit stream S
(1.19)  end for
```

Statement (1.1) scans the bit stream for a string of bits that match the synchronization pattern carried in the SI information. When the synchronization pattern is found, the start of a frame in the bit stream has been determined.

Statements (1.2) and (1.19) control the decoding process to be performed for each frame in the bit stream, or until the decoding process is stopped by some other means. Statements (1.3) to (1.18) perform processes that decode a frame in the encoded bit stream.

Statements (1.3) to (1.5) unpack metadata in the frame, obtain decoding parameters from the unpacked metadata, and determine the location in the bit stream where data begins for the first audio block K in the frame. Statement (1.16) determines the start of the next audio block in the bit stream if any subsequent audio block is in the frame.

Statements (1.6) and (1.17) cause the decoding process to be performed for each audio block in the frame. Statements (1.7) to (1.15) perform processes that decode an audio block in the frame. Statements (1.7) to (1.9) unpack metadata in the audio block, obtain decoding parameters from the unpacked metadata, and determine where data begins for the first channel.

Statements (1.10) and (1.15) cause the decoding process to be performed for each channel in the audio block. Statements (1.11) to (1.13) unpack and decode exponents, use the decoded exponents to determine the bit allocation to unpack and dequantize each quantized mantissa, and apply the synthesis filter bank to the dequantized mantissas. Statement (1.14) determines the location in the bit stream where data starts for the next channel, if any subsequent channel is in the frame.

The structure of the process varies to accommodate different coding techniques used to generate the encoded bit stream. Several variations are discussed and illustrated in program fragments below. The descriptions of the following program fragments omit some of the detail that is described for the preceding program fragment.

2. Spectral Extension

When spectral extension (SPX) is used, the audio block in which the extension process begins contains shared parameters needed for SPX in the beginning audio block as well as other audio blocks using SPX in the frame. The shared parameters include an identification of the channels participating in the process, the spectral extension frequency range, and how the SPX spectral envelope for each channel is shared across time and frequency. These parameters are unpacked from the audio block that begins the use of SPX and stored in memory or in computer registers for use in processing SPX in subsequent audio blocks in the frame.

It is possible for a frame to have more than one beginning audio block for SPX. A audio block begins SPX if the metadata for that audio block indicates SPX is used and either the metadata for the preceding audio block in the frame indicates SPX is not used or the audio block is the first block in a frame.

Each audio block that uses SPX either includes the SPX spectral envelope, referred to as SPX coordinates, that are used for spectral extension processing in that audio block or it includes a "reuse" flag that indicates the SPX coordinates for a previous block are to be used. The SPX coordinates in a block are unpacked and retained for possible reuse by SPX operations in subsequent audio blocks.

The following program fragment illustrates one way audio blocks using SPX may be processed.

```
(2.1)   determine start of a frame in bit stream S
(2.2)   for each frame N in bit stream S
(2.3)     unpack metadata in frame N
```

-continued

```
(2.4)     get parameters from unpacked frame metadata
(2.5)     if SPX frame parameters are present then unpack SPX frame
          parameters
(2.6)     determine start of first audio block K in frame N
(2.7)     for audio block K in frame N
(2.8)       unpack metadata in block K
(2.9)       get parameters from unpacked block metadata
(2.10)      if SPX block parameters are present then unpack SPX block
            parameters
(2.11)      for channel C in block K
(2.12)        unpack and decode exponents
(2.13)        unpack and dequantize mantissas
(2.14)        if channel C uses SPX then
(2.15)          extend bandwidth of channel C
(2.16)        end if
(2.17)        apply synthesis filter to decoded audio data for channel C
(2.18)        determine start of channel C+1 in block K
(2.19)      end for
(2.20)      determine start of block K+1 in frame N
(2.21)    end for
(2.22)    determine start of next frame N+1 in bit stream S
(2.23)  end for
```

Statement (2.5) unpacks SPX frame parameters from the frame metadata if any are present in that metadata. Statement (2.10) unpacks SPX block parameters from the block metadata if any are present in the block metadata. The block SPX parameters may include SPX coordinates for one or more channels in the block.

Statements (2.12) and (2.13) unpack and decode exponents and use the decoded exponents to determine the bit allocation to unpack and dequantize each quantized mantissa. Statement (2.14) determines whether channel C in the current audio block uses SPX. If it does use SPX, statement (2.15) applies SPX processing to extend the bandwidth of the channel C. This process provides the spectral components for channel C that are input to the synthesis filter bank applied in statement (2.17).

3. Adaptive Hybrid Transform

When the adaptive hybrid transform (AHT) is used, the first audio block AB0 in a frame contains all hybrid transform coefficients for each channel processed by the DCT-II transform. For all other channels, each of the six audio blocks in the frame contains as many as 256 spectral coefficients generated by the MDCT analysis filter bank.

For example, an encoded bit stream contains data for the left, center and right channels. When the left and right channels are processed by the AHT and the center channel is not processed by the AHT, audio block AB0 contains all of the hybrid transform coefficients for each of the left and right channels and contains as many as 256 MDCT spectral coefficients for the center channel. Audio blocks AB1 through AB5 contain MDCT spectral coefficients for the center channel and no coefficients for the left and right channels.

The following program fragment illustrates one way audio blocks with AHT coefficients may be processed.

```
(3.1)   determine start of a frame in bit stream S
(3.2)   for each frame N in bit stream S
(3.3)     unpack metadata in frame N
(3.4)     get parameters from unpacked frame metadata
(3.5)     determine start of first audio block K in frame N
(3.6)     for audio block K in frame N
(3.7)       unpack metadata in block K
(3.8)       get parameters from unpacked block metadata
(3.9)       determine start of first channel C in block K
(3.10)      for channel C in block K
```

-continued

```
(3.11)          if AHT is in use for channel C then
(3.12)            if K=0 then
(3.13)              unpack and decode exponents
(3.14)              unpack and dequantize mantissas
(3.15)              apply inverse secondary transform to exponents and
                    mantissas
(3.16)              store MDCT exponents and mantissas in buffer
(3.17)            end if
(3.18)            get MDCT exponents and mantissas for block K from
                  buffer
(3.19)          else
(3.20)            unpack and decode exponents
(3.21)            unpack and dequantize mantissas
(3.22)          end if
(3.23)          apply synthesis filter to decoded audio data for channel C
(3.24)          determine start of channel C+1 in block K
(3.25)        end for
(3.26)        determine start of block K+1 in frame N
(3.27)      end for
(3.28)      determine start of next frame N+1 in bit stream S
(3.29)    end for
```

Statement (3.11) determines whether the AHT is in use for the channel C. If it is in use, statement (3.12) determines whether the first audio block AB0 is being processed. If the first audio block is being processed, then statements (3.13) to (3.16) obtain all AHT coefficients for the channel C, apply the inverse secondary transform or IDCT-II to the AHT coefficients to obtain the MDCT spectral coefficients, and store them in a buffer. These spectral coefficients correspond to the exponents and dequantized mantissas that are obtained by statements (3.20) and (3.21) for channels for which AHT is not in use. Statement (3.18) obtains the exponents and mantissas of the MDCT spectral coefficients that correspond to the audio block K that is being processed. If the first audio block (K=0) is being processed, for example, then exponents and mantissas for the set of MDCT spectral coefficients for the first block are obtained from the buffer. If the second audio block (K=1) is being processed, for example, then the exponents and mantissas for the set of MDCT spectral coefficients for the second block is obtained from the buffer.

4. Spectral Extension and Adaptive Hybrid Transform

SPX and the AHT may be used to generate encoded data for the same channels. The logic discussed above separately for spectral extension and hybrid transform processing may be combined to process channels for which SPX is in use, the AHT is in use, or both SPX and the AHT are in use.

The following program fragment illustrates one way audio blocks with SPX and AHT coefficients may be processed.

```
(4.1)     start of a frame in bit stream S
(4.2)     for each frame N in bit stream S
(4.3)       unpack metadata in frame N
(4.4)       get parameters from unpacked frame metadata
(4.5)       if SPX frame parameters are present then unpack SPX frame
            parameters
(4.6)       determine start of first audio block K in frame N
(4.7)       for audio block K in frame N
(4.8)         unpack metadata in block K
(4.9)         get parameters from unpacked block metadata
(4.10)        if SPX block parameters are present then unpack SPX block
              parameters
(4.11)        for channel C in block K
(4.12)          if AHT in use for channel C then
(4.13)            if K=0 then
(4.14)              unpack and decode exponents
(4.15)              unpack and dequantize mantissas
(4.16)              apply inverse secondary transform to exponents and
                    mantissas
(4.17)              store inverse secondary transform exponents and
                    mantissas in buffer
(4.18)            end if
(4.19)            get inverse secondary transform exponents and
                  mantissas for block K from buffer
(4.20)          else
(4.21)            unpack and decode exponents
(4.22)            unpack and dequantize mantissas
(4.23)          end if
(4.24)          if channel C uses SPX then
(4.25)            extend bandwidth of channel C
(4.26)          end if
(4.27)          apply synthesis filter to decoded audio data for channel C
(4.28)          determine start of channel C+1 in block K
(4.29)        end for
(4.30)        determine start of block K+1 in frame N
(4.31)      end for
(4.32)      determine start of next frame N+1 in bit stream S
(4.33)    end for
```

Statement (4.5) unpacks SPX frame parameters from the frame metadata if any are present in that metadata. Statement (4.10) unpacks SPX block parameters from the block metadata if any are present in the block metadata. The block SPX parameters may include SPX coordinates for one or more channels in the block.

Statement (4.12) determines whether the AHT is in use for channel C. If the AHT is in use for channel C, statement (4.13) determines whether this is the first audio block. If it is the first audio block, statements (4.14) through (4.17) obtain all AHT coefficients for the channel C, apply the inverse secondary transform or IDCT-II to the AHT coefficients to obtain inverse secondary transform coefficients, and store them in a buffer. Statement (4.19) obtains the exponents and mantissas of the inverse secondary transform coefficients that correspond to the audio block K that is being processed.

If the AHT is not in use for channel C, statements (4.21) and (4.22) unpack and obtain the exponents and mantissas for the channel C in block K as discussed above for program statements (1.11) and (1.12).

Statement (4.24) determines whether channel C in the current audio block uses SPX. If it does use SPX, statement (4.25) applies SPX processing to the inverse secondary transform coefficients to extend the bandwidth, thereby obtaining the MDCT spectral coefficients of the channel C. This process provides the spectral components for channel C that are input to the synthesis filter bank applied in statement (4.27). If SPX processing is not used for channel C, the MDCT spectral coefficients are obtained directly from the inverse secondary transform coefficients.

5. Coupling and Adaptive Hybrid Transform

Channel coupling and the AHT may be used to generate encoded data for the same channels. Essentially the same logic discussed above for spectral extension and hybrid transform processing may be used to process bit streams using channel coupling and the AHT because the details of SPX processing discussed above apply to the processing performed for channel coupling.

The following program fragment illustrates one way audio blocks with coupling and AHT coefficients may be processed.

```
(5.1)     start of a frame in bit stream S
(5.2)     for each frame N in bit stream S
```

-continued

```
(5.3)    unpack metadata in frame N
(5.4)    get parameters from unpacked frame metadata
(5.5)     if coupling frame parameters are present then unpack
          coupling frame parameters
(5.6)    determine start of first audio block K in frame N
(5.7)    for audio block K in frame N
(5.8)      unpack metadata in block K
(5.9)      get parameters from unpacked block metadata
(5.10)     if coupling block parameters are present then unpack
           coupling block parameters
(5.11)     for channel C in block K
(5.12)       if AHT in use for channel C then
(5.13)         if K=0 then
(5.14)           unpack and decode exponents
(5.15)           unpack and dequantize mantissas
(5.16)           apply inverse secondary transform to exponents and
                 mantissas
(5.17)           store inverse secondary transform exponents and
                 mantissas in buffer
(5.18)         end if
(5.19)         get inverse secondary transform exponents and
               mantissas for block K from buffer
(5.20)       else
(5.21)         unpack and decode exponents for channel C
(5.22)         unpack and dequantize mantissas for channel C
(5.23)       end if
(5.24)       if channel C uses coupling then
(5.25)         if channel C is first channel to use coupling then
(5.26)           if AHT in use for the coupling channel then
(5.27)             if K=0 then
(5.28)               unpack and decode coupling channel exponents
(5.29)               unpack and dequantize coupling channel
                     mantissas
(5.30)               apply inverse secondary transform to coupling
                     channel
(5.31)               store inverse secondary transform coupling
                     channel
                       exponents and mantissas in buffer
(5.32)             end if
(5.33)             get coupling channel exponents and mantissas for
                   block K from buffer
(5.34)           else
(5.35)             unpack and decode coupling channel exponents
(5.36)             unpack and dequantize coupling channel
                   mantissas
(5.37)           end if
(5.38)         end if
(5.39)         obtain coupled channel C from coupling channel
(5.40)       end if
(5.41)       apply synthesis filter to decoded audio data for channel C
(5.42)       determine start of channel C+1 in block K
(5.43)     end for
(5.44)     determine start of block K+1 in frame N
(5.45)   end for
(5.46)   determine start of next frame N+1 in bit stream S
(5.47) end for
```

Statement (5.5) unpacks channel coupling parameters from the frame metadata if any are present in that metadata. Statement (5.10) unpacks channel coupling parameters from the block metadata if any are present in the block metadata. If they are present, coupling coordinates are obtained for the coupled channels in the block.

Statement (5.12) determines whether the AHT is in use for channel C. If the AHT is in use, statement (5.13) determines whether it is the first audio block. If it is the first audio block, statements (5.14) through (5.17) obtain all AHT coefficients for the channel C, apply the inverse secondary transform or IDCT-II to the AHT coefficients to obtain inverse secondary transform coefficients, and store them in a buffer. Statement (5.19) obtains the exponents and mantissas of the inverse secondary transform coefficients that correspond to the audio block K that is being processed.

If the AHT is not in use for channel C, statements (5.21) and (5.22) unpack and obtain the exponents and mantissas for the channel C in block K as discussed above for program statements (1.11) and (1.12).

Statement (5.24) determines whether channel coupling is in use for channel C. If it is in use, statement (5.25) determines whether channel C is the first channel in the block to use coupling. If it is, the exponents and mantissas for the coupling channel are obtained either from an application of an inverse secondary transform to the coupling channel exponents and mantissas as shown in statements (5.26) through (5.33) or from data in the bit stream as shown in statements (5.35) and (5.36). The data representing the coupling channel mantissas are placed in the bit stream immediately after the data representing mantissas of the channel C. Statement (5.39) derives the coupled channel C from the coupling channel using the appropriate coupling coordinates for the channel C. If channel coupling is not used for channel C, the MDCT spectral coefficients are obtained directly from the inverse secondary transform coefficients.

6. Spectral Extension, Coupling and Adaptive Hybrid Transform

Spectral extension, channel coupling and the AHT may all be used to generate encoded data for the same channels. The logic discussed above for combinations of AHT processing with spectral extension and coupling may be combined to process channels using any combination of the three coding tools by incorporating the additional logic necessary to handle eight possible situations. The processing for channel decoupling is performed before performing SPX processing.

F. Implementation

Figure 8:
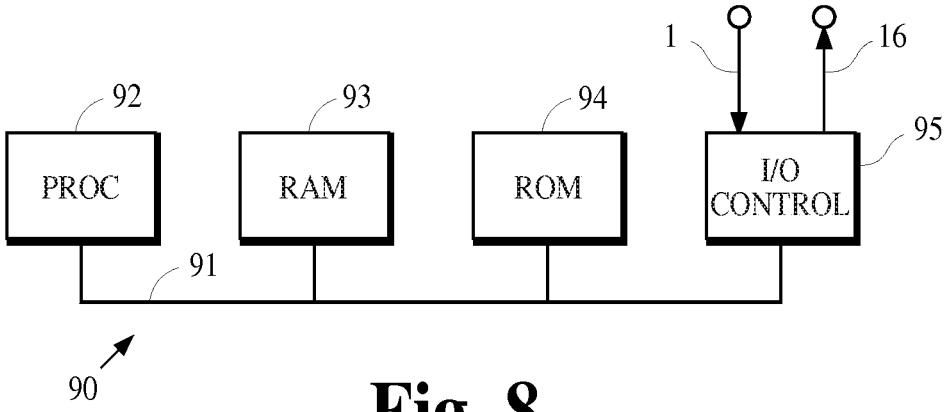
FIG. 8 is a schematic block diagram of a device that may be used to implement various aspects of the present invention.

Devices that incorporate various aspects of the present invention may be implemented in a variety of ways including software for execution by a computer or some other device that includes more specialized components such as digital signal processor (DSP) circuitry coupled to components similar to those found in a general-purpose computer. FIG. 8 is a schematic block diagram of a device 90 that may be used to implement aspects of the present invention. The processor 92 provides computing resources. RAM 93 is system random access memory (RAM) used by the processor 92 for processing. ROM 94 represents some form of persistent storage such as read only memory (ROM) for storing programs needed to operate the device 90 and possibly for carrying out various aspects of the present invention. I/O control 95 represents interface circuitry to receive and transmit signals by way of the communication channels 1, 16. In the embodiment shown, all major system components connect to the bus 91, which may represent more than one physical or logical bus; however, a bus architecture is not required to implement the present invention.

In embodiments implemented by a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include programs that implement various aspects of the present invention.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media including paper.

The invention claimed is:

1. A method for decoding a frame of an encoded digital audio signal, wherein:

the frame comprises frame metadata, a first audio block and one or more subsequent audio blocks; and each of the first and subsequent audio blocks comprises block metadata and encoded audio data for two or more audio channels, wherein:

the encoded audio data comprises scale factors and scaled values representing spectral content of the two or more audio channels, each scaled value being associated with a respective one of the scale factors; and the block metadata comprises control information describing coding tools used by an encoding process that produced the encoded audio data, the coding tools including adaptive hybrid transform processing that comprises:

applying an analysis filter bank implemented by a primary transform to the two or more audio channels to generate primary transform coefficients, and applying a secondary transform to the primary transform coefficients for at least some of the two or more audio channels to generate hybrid transform coefficients;

and wherein the method comprises:

(A) receiving the frame of the encoded digital audio signal; and (B) examining the encoded digital audio signal of the frame in a single pass to decode the encoded audio data for each audio block in order by block, wherein the decoding of each respective audio block comprises:

(1) determining for each respective channel of the two or more channels whether the encoding process used adaptive hybrid transform processing to encode any of the encoded audio data;

(2) if the encoding process used adaptive hybrid transform processing for the respective channel:

(a) if the respective audio block is the first audio block in the frame:

(i) obtaining all hybrid transform coefficients of the respective channel for the frame from the encoded audio data in the first audio block, and (ii) applying an inverse secondary transform to the hybrid transform coefficients to obtain inverse secondary transform coefficients, and (b) obtaining primary transform coefficients from the inverse secondary transform coefficients for the respective channel in the respective audio block;

(3) if the encoding process did not use adaptive hybrid transform processing for the respective channel, obtaining primary transform coefficients for the respective channel by decoding the encoded data in the respective audio block; and (C) applying an inverse primary transform to the primary transform coefficients to generate an output signal representing the respective channel in the respective audio block.

2. The method of claim 1, wherein the frame of the encoded digital audio signal complies with enhanced AC-3 bit stream syntax.

3. The method of claim 2, wherein the coding tools include spectral extension processing and the decoding of each respective audio block further comprises:

determining whether the decoding process should use spectral extension processing to decode any of the encoded audio data; and if spectral extension processing should be used, synthesizing one or more spectral components from the inverse secondary transform coefficients to obtain primary transform coefficients with an extended bandwidth.

4. The method of claim 3, wherein the coding tools include channel coupling and the decoding of each respective audio block further comprises:

determining whether the encoding process used channel coupling to encode any of the encoded audio data; and if the encoding process used channel coupling, deriving spectral components from the inverse secondary transform coefficients to obtain primary transform coefficients for coupled channels.

5. The method of claim 3, wherein the coding tools include channel coupling and the decoding of each respective audio block further comprises:

determining whether the encoding process used channel coupling to encode any of the encoded audio data; and if the encoding process used channel coupling:

(A) if the respective channel is a first channel to use coupling in the frame:

(1) determining whether the encoding process used adaptive hybrid transform processing to encode the coupling channel, (2) if the encoding process used adaptive hybrid transform processing to encode the coupling channel:

(a) if the respective audio block is the first audio block in the frame:

(i) obtaining all hybrid transform coefficients for the coupling channel in the frame from the encoded audio data in the first audio block, and (ii) applying an inverse secondary transform to the hybrid transform coefficients to obtain inverse secondary transform coefficients, (b) obtaining primary transform coefficients from the inverse secondary transform coefficients for the coupling channel in the respective audio block;

(3) if the encoding process did not use adaptive hybrid transform processing to encode the coupling channel, obtaining spectral components for the coupling channel by decoding the encoded data in the respective audio block; and (B) obtaining primary transform coefficients for the respective channel by decoupling the spectral components for the coupling channel.

6. The method of claim 2, wherein the coding tools include channel coupling and the decoding of each respective audio block further comprises:

determining whether the encoding process used channel coupling to encode any of the encoded audio data; and if the encoding process used channel coupling, deriving spectral components from the inverse secondary transform coefficients to obtain primary transform coefficients for coupled channels.

7. The method of claim 2, wherein the coding tools include channel coupling and the decoding of each respective audio block further comprises:

determining whether the encoding process used channel coupling to encode any of the encoded audio data; and if the encoding process used channel coupling:

(A) if the respective channel is a first channel to use coupling in the frame:

(1) determining whether the encoding process used adaptive hybrid transform processing to encode the coupling channel, (2) if the encoding process used adaptive hybrid transform processing to encode the coupling channel:

(a) if the respective audio block is the first audio block in the frame:

(i) obtaining all hybrid transform coefficients for the coupling channel in the frame from the encoded audio data in the first audio block, and (ii) applying an inverse secondary transform to the hybrid transform coefficients to obtain inverse secondary transform coefficients, (b) obtaining primary transform coefficients from the inverse secondary transform coefficients for the coupling channel in the respective audio block;

(3) if the encoding process did not use adaptive hybrid transform processing to encode the coupling channel, obtaining spectral components for the coupling channel by decoding the encoded data in the respective audio block; and (B) obtaining primary transform coefficients for the respective channel by decoupling the spectral components for the coupling channel.

8. An apparatus for decoding a frame of an encoded digital audio signal, wherein:

the frame comprises frame metadata, a first audio block and one or more subsequent audio blocks; and each of the first and subsequent audio blocks comprises block metadata and encoded audio data for two or more audio channels, wherein:

the encoded audio data comprises scale factors and scaled values representing spectral content of the two or more audio channels, each scaled value being associated with a respective one of the scale factors; and the block metadata comprises control information describing coding tools used by an encoding process that produced the encoded audio data, the coding tools including adaptive hybrid transform processing that comprises:

applying an analysis filter bank implemented by a primary transform to the two or more audio channels to generate primary transform coefficients, and applying a secondary transform to the primary transform coefficients for at least some of the two or more audio channels to generate hybrid transform coefficients;

and wherein the apparatus comprises:

(A) means for receiving the frame of the encoded digital audio signal; and (B) means for examining the encoded digital audio signal of the frame in a single pass and for decoding the encoded audio data for each audio block in order by block, wherein for the decoding of each respective audio block the apparatus comprises means for:

(1) determining for each respective channel of the two or more channels whether the encoding process used adaptive hybrid transform processing to encode any of the encoded audio data;

(2) if the encoding process used adaptive hybrid transform processing for the respective channel:

(a) if the respective audio block is the first audio block in the frame:

(i) obtaining all hybrid transform coefficients of the respective channel for the frame from the encoded audio data in the first audio block, and (ii) applying an inverse secondary transform to the hybrid transform coefficients to obtain inverse secondary transform coefficients, and (b) obtaining primary transform coefficients from the inverse secondary transform coefficients for the respective channel in the respective audio block;

(3) if the encoding process did not use adaptive hybrid transform processing for the respective channel, obtaining primary transform coefficients for the respective channel by decoding the encoded data in the respective audio block; and (C) means for applying an inverse primary transform to the primary transform coefficients to generate an output signal representing the respective channel in the respective audio block.

9. The apparatus of claim 8, wherein the frame of the encoded digital audio signal complies with enhanced AC-3 bit stream syntax.

10. The apparatus of claim 9, wherein the coding tools include spectral extension processing and for the decoding of each respective audio block the apparatus further comprises means for:

determining whether the decoding process should use spectral extension processing to decode any of the encoded audio data; and if spectral extension processing should be used, synthesizing one or more spectral components from the inverse secondary transform coefficients to obtain primary transform coefficients with an extended bandwidth.

11. The apparatus of claim 10, wherein the coding tools include channel coupling and for the decoding of each respective audio block the apparatus further comprises means for:

determining whether the encoding process used channel coupling to encode any of the encoded audio data; and if the encoding process used channel coupling, deriving spectral components from the inverse secondary transform coefficients to obtain primary transform coefficients for coupled channels.

12. The apparatus of claim 10, wherein the coding tools include channel coupling and for the decoding of each respective audio block the apparatus further comprises means for:

determining whether the encoding process used channel coupling to encode any of the encoded audio data; and if the encoding process used channel coupling:

(A) if the respective channel is a first channel to use coupling in the frame:

(1) determining whether the encoding process used adaptive hybrid transform processing to encode the coupling channel, (2) if the encoding process used adaptive hybrid transform processing to encode the coupling channel:

(a) if the respective audio block is the first audio block in the frame:

(i) obtaining all hybrid transform coefficients for the coupling channel in the frame from the encoded audio data in the first audio block, and (ii) applying an inverse secondary transform to the hybrid transform coefficients to obtain inverse secondary transform coefficients, (b) obtaining primary transform coefficients from the inverse secondary transform coefficients for the coupling channel in the respective audio block;

(3) if the encoding process did not use adaptive hybrid transform processing to encode the coupling channel, obtaining spectral components for the coupling channel by decoding the encoded data in the respective audio block; and (B) obtaining primary transform coefficients for the respective channel by decoupling the spectral components for the coupling channel.

13. The apparatus of claim 9, wherein the coding tools include channel coupling and for the decoding of each respective audio block the apparatus further comprises means for:

determining whether the encoding process used channel coupling to encode any of the encoded audio data; and if the encoding process used channel coupling, deriving spectral components from the inverse secondary transform coefficients to obtain primary transform coefficients for coupled channels.

14. The apparatus of claim 9, wherein the coding tools include channel coupling and for the decoding of each respective audio block the apparatus further comprises means for:

determining whether the encoding process used channel coupling to encode any of the encoded audio data; and if the encoding process used channel coupling:

(A) if the respective channel is a first channel to use coupling in the frame:

(1) determining whether the encoding process used adaptive hybrid transform processing to encode the coupling channel, (2) if the encoding process used adaptive hybrid transform processing to encode the coupling channel:

(a) if the respective audio block is the first audio block in the frame:

(i) obtaining all hybrid transform coefficients for the coupling channel in the frame from the encoded audio data in the first audio block, and (ii) applying an inverse secondary transform to the hybrid transform coefficients to obtain inverse secondary transform coefficients, (b) obtaining primary transform coefficients from the inverse secondary transform coefficients for the coupling channel in the respective audio block;

(3) if the encoding process did not use adaptive hybrid transform processing to encode the coupling channel, obtaining spectral components for the coupling channel by decoding the encoded data in the respective audio block; and (B) obtaining primary transform coefficients for the respective channel by decoupling the spectral components for the coupling channel.

15. A non-transitory medium that records a program of instructions executable by a device to perform a method for decoding a frame of an encoded digital audio signal, wherein:

the frame comprises frame metadata, a first audio block and one or more subsequent audio blocks; and each of the first and subsequent audio blocks comprises block metadata and encoded audio data for two or more audio channels, wherein:

the encoded audio data comprises scale factors and scaled values representing spectral content of the two or more audio channels, each scaled value being associated with a respective one of the scale factors; and the block metadata comprises control information describing coding tools used by an encoding process that produced the encoded audio data, the coding tools including adaptive hybrid transform processing that comprises:

applying an analysis filter bank implemented by a primary transform to the two or more audio channels to generate primary transform coefficients, and applying a secondary transform to the primary transform coefficients for at least some of the two or more audio channels to generate hybrid transform coefficients;

and wherein the method comprises:

(A) receiving the frame of the encoded digital audio signal; and (B) examining the encoded digital audio signal of the frame in a single pass to decode the encoded audio data for each audio block in order by block, wherein the decoding of each respective audio block comprises:

(1) determining for each respective channel of the two or more channels whether the encoding process used adaptive hybrid transform processing to encode any of the encoded audio data;

(2) if the encoding process used adaptive hybrid transform processing for the respective channel:

(a) if the respective audio block is the first audio block in the frame:

(i) obtaining all hybrid transform coefficients of the respective channel for the frame from the encoded audio data in the first audio block, and (ii) applying an inverse secondary transform to the hybrid transform coefficients to obtain inverse secondary transform coefficients, and (b) obtaining primary transform coefficients from the inverse secondary transform coefficients for the respective channel in the respective audio block;

(3) if the encoding process did not use adaptive hybrid transform processing for the respective channel, obtaining primary transform coefficients for the respective channel by decoding the encoded data in the respective audio block; and (C) applying an inverse primary transform to the primary transform coefficients to generate an output signal representing the respective channel in the respective audio block.

16. The medium of claim 15, wherein the frame of the encoded digital audio signal complies with enhanced AC-3 bit stream syntax.

17. The medium of claim 16, wherein the coding tools include spectral extension processing and the decoding of each respective audio block further comprises:

determining whether the decoding process should use spectral extension processing to decode any of the encoded audio data; and if spectral extension processing should be used, synthesizing one or more spectral components from the inverse secondary transform coefficients to obtain primary transform coefficients with an extended bandwidth.

18. The medium of claim 17, wherein the coding tools include channel coupling and the decoding of each respective audio block further comprises:

determining whether the encoding process used channel coupling to encode any of the encoded audio data; and if the encoding process used channel coupling, deriving spectral components from the inverse secondary transform coefficients to obtain primary transform coefficients for coupled channels.

19. The medium of claim 17, wherein the coding tools include channel coupling and the decoding of each respective audio block further comprises:

determining whether the encoding process used channel coupling to encode any of the encoded audio data; and if the encoding process used channel coupling:

(A) if the respective channel is a first channel to use coupling in the frame:

(1) determining whether the encoding process used adaptive hybrid transform processing to encode the coupling channel, (2) if the encoding process used adaptive hybrid transform processing to encode the coupling channel:

(a) if the respective audio block is the first audio block in the frame:

(i) obtaining all hybrid transform coefficients for the coupling channel in the frame from the encoded audio data in the first audio block, and (ii) applying an inverse secondary transform to the hybrid transform coefficients to obtain inverse secondary transform coefficients, (b) obtaining primary transform coefficients from the inverse secondary transform coefficients for the coupling channel in the respective audio block;

(3) if the encoding process did not use adaptive hybrid transform processing to encode the coupling channel, obtaining spectral components for the coupling channel by decoding the encoded data in the respective audio block; and (B) obtaining primary transform coefficients for the respective channel by decoupling the spectral components for the coupling channel.

20. The medium of claim 16, wherein the coding tools include channel coupling and the decoding of each respective audio block further comprises:

determining whether the encoding process used channel coupling to encode any of the encoded audio data; and if the encoding process used channel coupling, deriving spectral components from the inverse secondary transform coefficients to obtain primary transform coefficients for coupled channels.

21. The medium of claim 16, wherein the coding tools include channel coupling and the decoding of each respective audio block further comprises:

determining whether the encoding process used channel coupling to encode any of the encoded audio data; and if the encoding process used channel coupling:

(A) if the respective channel is a first channel to use coupling in the frame:

(1) determining whether the encoding process used adaptive hybrid transform processing to encode the coupling channel, (2) if the encoding process used adaptive hybrid transform processing to encode the coupling channel:

(a) if the respective audio block is the first audio block in the frame:

(i) obtaining all hybrid transform coefficients for the coupling channel in the frame from the encoded audio data in the first audio block, and (ii) applying an inverse secondary transform to the hybrid transform coefficients to obtain inverse secondary transform coefficients, (b) obtaining primary transform coefficients from the inverse secondary transform coefficients for the coupling channel in the respective audio block;

(3) if the encoding process did not use adaptive hybrid transform processing to encode the coupling channel, obtaining spectral components for the coupling channel by decoding the encoded data in the respective audio block; and (B) obtaining primary transform coefficients for the respective channel by decoupling the spectral components for the coupling channel.

* * * * *